United States Patent [19]

Beretta

[11] Patent Number: 4,697,495

[45] Date of Patent: Oct. 6, 1987

[54] TRIPPING MECHANISM FOR THE CONVERSION CLOSED-BOLT AUTOMATIC RIFLES TO OPEN-BOLT ONES

[75] Inventor: Pier G. Beretta, Brescia, Italy

[73] Assignee: Fabrica d'Armi P.Beretta S.p.A., Italy

[21] Appl. No.: 806,283

[22] Filed: Dec. 6, 1985

[30] Foreign Application Priority Data

Dec. 10, 1984 [IT] Italy ..... 5243 A/84

[51] Int. Cl.[4] ..... F41C 17/06; F41C 5/06

[52] U.S. Cl. ..... 89/143; 89/142

[58] Field of Search ..... 89/141, 143, 144, 140, 89/142, 150

[56] References Cited

U.S. PATENT DOCUMENTS

| | | | |
|---|---|---|---|
| 1,911,494 | 5/1933 | Floyd | 89/150 |
| 2,058,746 | 10/1936 | Westinger | 89/141 |
| 2,324,125 | 7/1943 | Van Horn et al. | 89/140 |
| 3,446,114 | 3/1969 | Ketterer | 89/140 |

FOREIGN PATENT DOCUMENTS

| | | | |
|---|---|---|---|
| 740091 | 8/1943 | Fed. Rep. of Germany | 89/140 |
| 748828 | 5/1956 | United Kingdom | 89/140 |

*Primary Examiner*—Stephen C. Bentley
*Assistant Examiner*—Stephen M. Johnson
*Attorney, Agent, or Firm*—McGlew and Tuttle

[57] ABSTRACT

A tripping mechanism is disclosed for the conversion of automatic rifles of the so-called closed-bolt type to rifles of the open-bolt type. The components of the mechanism are premounted within a box-like support which is readily insertable in the trip box of a conventional automatic rifle. The mechanism includes a trigger, a trip block for arresting the bolt carriage in the open, armed position, a connecting rod attached to and displaceable with the trigger and cooperating with the trip block during the disengagement of the bolt carriage from its blocked position, a safety bolt operating also as selector of the firing mode by cooperating with a lever, a lever for engaging the trigger during the automatic, continuous firing mode, and, finally, a safety block for arresting the bolt carriage in the event of accidental disengagement from the trip block.

5 Claims, 11 Drawing Figures

TRIPPING MECHANISM FOR THE CONVERSION CLOSED-BOLT AUTOMATIC RIFLES TO OPEN-BOLT ONES

FIELD OF THE INVENTION.

The present invention is related to a tripping mechanism for automatic weapons; more specifically, to a tripping mechanism for the conversion of automatic rifles of the so-called closed-bolt type to rifles of the open-bolt type, so as to allow the selection of either single firing or automatic fire.

DESCRIPTION OF THE PRIOR ART.

In the field of automatic weapons, such as automatic rifles, both the so-called closed-bolt automatic rifles and the so-called open-bolt automatic rifles are well known. The former ones are provided with a firing mechanism which includes a hammer striking rotationally, while in the latter ones the verv same bolt carriage of the rifle can be engaged in the armed position by means of a tripping mechanism and then disengaged to form the striking mass for the firing of the cartridge in the chamber of the rifle.

Both systems and arrangements are generally suited for firing single shots or automatically, respectively, and for this purpose the tripping mechanism of the weapon comprises a firing selector for the desired mode, such mechanism being also structured so as to block the trigger in the position of safety.

On the other hand, however, the automatic weapons of the so-called open-bolt type are safer and more reliable from the functional point of view, specially when employed in a sustained volume of fire, because the bolt carriage remains in the withdrawn position and the firing chamber is empty, thus eliminating the danger of an accidental firing.

SUMMARY OF THE INVENTION

The tripping mechanism of the present invention is especially directed to automatic rifles of the open-bolt type, and particularly to the conversion of of automatic rifles of the so called closed-bolt type into rifles of the open-bolt type without any modification to the body or to the bolt carriage of the rifle.

To this purpose, the member components of the tripping mechanism, according to the invention, are premounted and enclosed in a box-like support easily insertable within the trip box of the weapon, instead of the traditional tripping mechanism with a striking hammer. The tripping mechanism of the invention, thus, presents the advantage of being easily assembled, of permitting the most rapid conversion of the closed-bolt rifles into open-bolt ones, and of permitting ease of maintenance and interchanging of the various members of the tripping mechanism.

BRIEF DESCRIPTION OF THE DRAWINGS

Greater details of the invention will be set forth in the following description thereof and will become appratent from the accompanying drawings, in which, illustratively and not limitatively.

DESCRIPTION OF THE PREFERRED EMBODIMENTS

Figure 2:
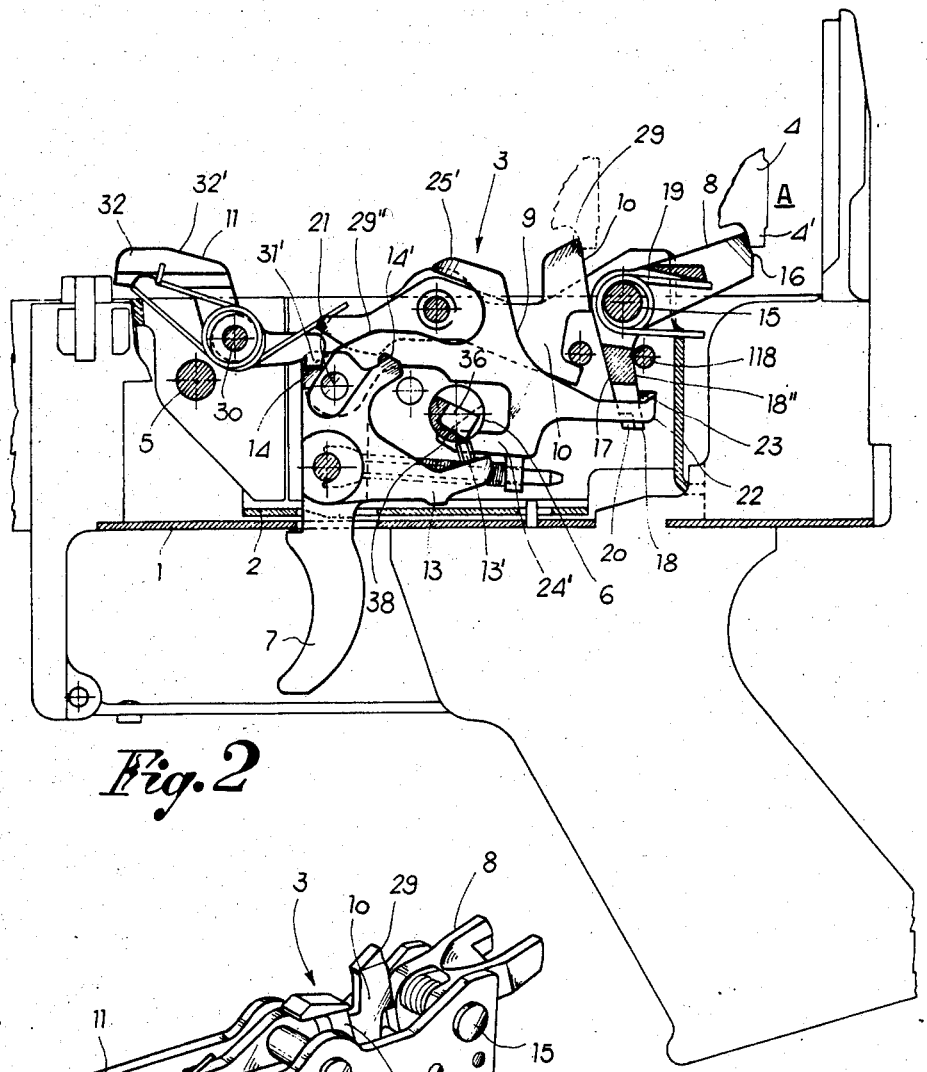
FIG. 2 is a sectional view of a portion of an automatic rifle containing the tripping mechanism in position of safety and with bolt carriage blocked in withdrawn position (armed)
Figure 1:
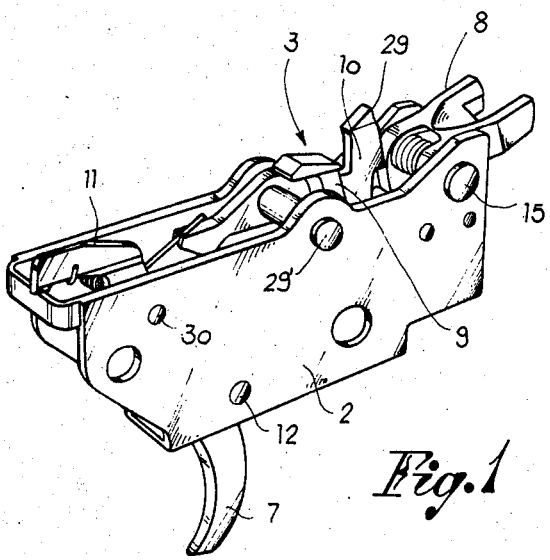
FIG. 1 is a perspective view of the tripping mechanism pre-mounted in a support box-like body and insertable, as a unit, in the trip box of an automatic rifle.

Referring now to the accompanying drawings, reference numeral 1 represents, generically, the trip box of an automatic rifle, in which there is mounted the tripping mechanism 3 by means of box-like support 2. Tripping mechanism 3 serves to control the bolt carriage 4 of the weapon, the carriage being guided and displaced in known manner from a withdrawn and back position A (armed) to an advanced and forward position B (percussion or firing), and back again. All the member components of the tripping mechanism are pre-mounted in the box-like support 2 for the insertion, as a unit, within the trip box 1. The box-like support 2 is blocked in the trip box 1 by means of at least one pin 5 and by the safety rod 6 of the tripping mechanism.

The tripping mechanism 3, in greater detail, comprises a trigger 7, a trip box 8, a connecting rod 9, the above mentioned safety rod 6 (which serves also as firing mode selector and which is positioned between the trigger 7 and the connecting rod 9), a safety block 10 and an engaging lever 11. This lever 11 serves to couple itself to the trigger during the automatic firing.

Trigger 7 is mounted on the box-like support 2 by means of a pin 12 and is provided with a tail 13 which faces backward and is provided with a pin 13'. Trigger 7, furthermore, has an upwardly extending arm which carries at least one tooth 14 and at least part of a pin 14', the function of which will become apparent hereinafter.

Figure 9:
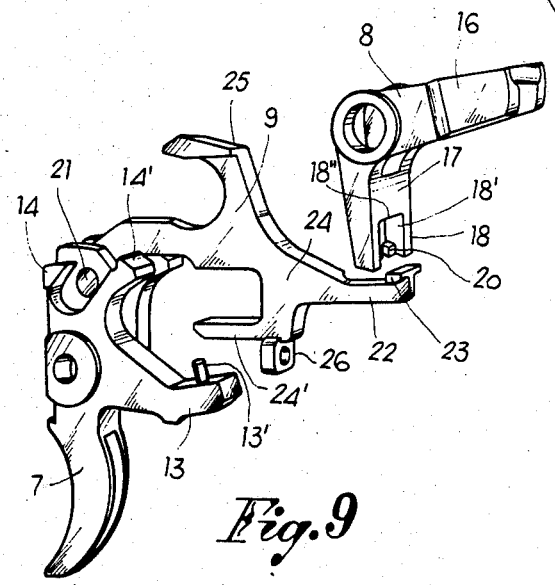
FIG. 9 is a perspective view in exploded format of the trigger, the connecting rod and the trip block of the rifle.

The trip block 8 is mounted, in pendular-like fashion, in the box-like support 2 by means of a pin 15 and has a first arm 16 facing obliquely upwardly and engaging head-on with an arresting shoulder 4' which is provided on the bolt carriage 4, so that the bolt carriage be stopped in the armed, withdrawn position A. Trip block 8 has a second arm 17 facinq downwardly and terminating in its lower portion with a bifurcated extremity 18. Trip block 8 is urged by a spring 19 which tends to rotate the block itself in such a way that its first arm 16 be normally facing upwardly in position of interception and engagement with the arresting shoulder 4' of the bolt carriage 4. Spring 19 is further limited by a pin 118. The fork-like portion 18 of the second arm 7 of the trip block 8 defines a cut or notch 18', open toward the underside and close on the upperside by a full portion 18". On the two branches of the fork-like extremity are provided two opposed pegs 20 facing toward the center of the opening 18' (see FIG. 9).

The connecting rod 9 is mounted on the upper arm of the trigger 7 by means of a pin 21, so as to move concurrently with the trigger, but also independently thereof, on pin 21. The connecting rod 9 extends rearwardly, where it ends with an arm 22 positioned in correspondence with the cut or opening 18' of the fork-like portion 18 of the trip block. The arm 22 is shaped so as to penetrate from beneath and upwardly into the opening 18', passing between the two opposed pegs 20. The arm 22 of the connecting rod 9 is furthermore provided with a stepwise shoulder 23 protruding from the sides of the arm and serving to cooperate selectively with the full portion 18" which superimposes on the fork-like member 18 of the trip block 8, and to further cooperate also with the pegs 20 of the fork-like member, so that the trip block 8 be displaced in opposition to the action of the spring 19, that is to say, away from the shoulder 4' of the bolt carriage 4.

On its intermediate portion, the connecting rod 9 has a C-shaped arm 24 facinq downwardly and a second C-shaped arm 25 facing upwardly. Arm 24 has an horizontal portion 24', or substantially horizontal, which passes beneath the safety rod 6 and cooperates therewith. Arm 24 is also provided with a perforated support 26 through which is guided an extremity of a spring-carrying rod 27, the opposite extremity which rod being testing on pin 12 of the trigger 7. On the rod 27 is mounted a pre-stressed spring 28, which tends to displce normally the connecting rod upwardly to a position wherein the stepwise shoulder 23 of the back arm 22 of the connecting rod cooperates with the trip block 8, such a displacement being in any event defined and limited by the horizontal portion of the arm 24 cooperating with the safety rod 6.

Arm 25 of the connecting rod, faced upwardly, has on its top an inclined plane 25' which serves to cooperate with a similar inclined plane 4" provided on the bolt carriage 4, when this latter passes from position A to position B, so as to determine the disconnection of the connecting rod 9 from the trip block 8.

As to the safety block 10, this is mounted, in pendular-like fashion, in the box-like support 2 by means of a pin 29'. and on its back it has a terminal 29' for intercepting the shoulder 4' of the bolt carriage 4, as shown in phantom lines in FIG. 2, whenever the carriage is not properly engaged or escapes accidentally from the trip block 8.

In front, the safety block 10 is provided with a cam-like appendix 29" for cooperation with the member 14' of the upper arm of the trigger 7. The engaging lever 11 is pivoting in the box-like support 2 by means of a pin 30 and it displays a first arm 31 faced toward the appendix 29" of the safety block 10. This first arm has a peg 31' which cooperates with the tooth 14 of the trigger 7. The engaging lever 11 also displays a second arm 32 facing in the opposite direction from the first arm and having an upper surface 32' so positioned as to be engaged bv the bolt carriage when it is displaced forwardly in the position B.

The safety block 10 and the engaqing lever 11 are actuated by springs 33 and 34, respectively, which tend to keep the block and the lever normally in their respective positions of interception and of engagement by the bolt carriage 4. These positions are defined by a pin 35 for the safety block 10 and by the peg 31' of the engaging lever 11 on the tooth 14 of the upper arm of the trigger. The safety block 10 and the engaging lever 11 are, nevertheless, dispaceable in opposition to the action of their respective springs by the bolt carriage 4.

The safety rod is transversely mounted on the box-like support 2 and is provided, at one or both extremities thereof, with a manouver lever 6' for its rotation and for its arrest in the positions of safety or of individual firing or of automatic rapid firing.

Figure 11:
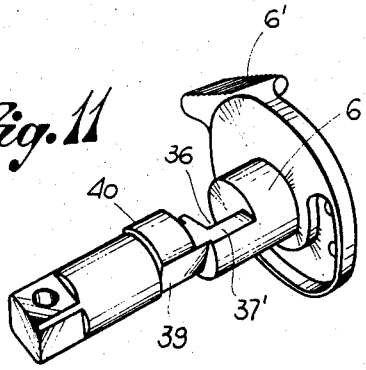
FIGS. 10 and 11 shows two representations, perspectively of the safety bolt, serving also as selector for the firing mode.
Figure 10:
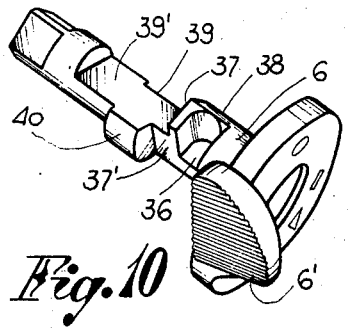

The safety rod 6 is provided on its intermediate portion with the following members: a cavity 36 for receiving the pin 13' on the tail 13 of the trigger 7; a cam-shaped portion, formed by two flat surfaces of diverse depth 37—37' and by a cylindrical surface 38, said cam-shaped portion cooperating with the tail 13 of the trigger; a second, cam-shaped portion, also having two flat surfaces of various depth 39—39' and a cylindrical surface 40, said second cam-shaped portion cooperating with the lower arm 24 of the connecting rod 9 (see also FIGS. 10 and 11), the surface 40 of the safety rod which is not affected by the cavity and by the flat surfaces mentioned above being in this case cylindrical.

FIG. 2 of the accompanying drawings depicts the tripping mechanism in position of safety and with the bolt carriage 4 arrested in the backward position A by the trip block 8, although such a position can be attained equally with the bolt carriage in the advanced or forward position, that is, the closing position.

In such a position, the safety rod 6 is rotated, so as to rest with its cylindrical surface 38 on the pin 13' of the tail 13 of the trigger 7 and to prevent the functioning of the latter and therefore, the use of the rifle. On the other hand, in this position, the safety rod 6 acts also, with the other cam-shaped portion, on the horizontal surface of the lower arm 24 of the connecting rod 9, so as to arrest the latter in a neutral position without affecting the trip block 8. In this case, the stepwise shoulder 23 of the rear arm 22 of the connecting rod 9 is at a height intermediate the pegs 20 and the full portion 18" of the fork-1ike member 18 of the trip block 8, without affecting either the pegs or the full portion; and this occurs either when the bolt carriage is arrested by the trip block 8 or when it is in the forward position and and is subject to a backward manual displacement.

Starting from the position of safety, it is possible to rotate the rod-selector 6, so as to pre-arrange the weapon for either individual or automatic firing.

Figure 3:
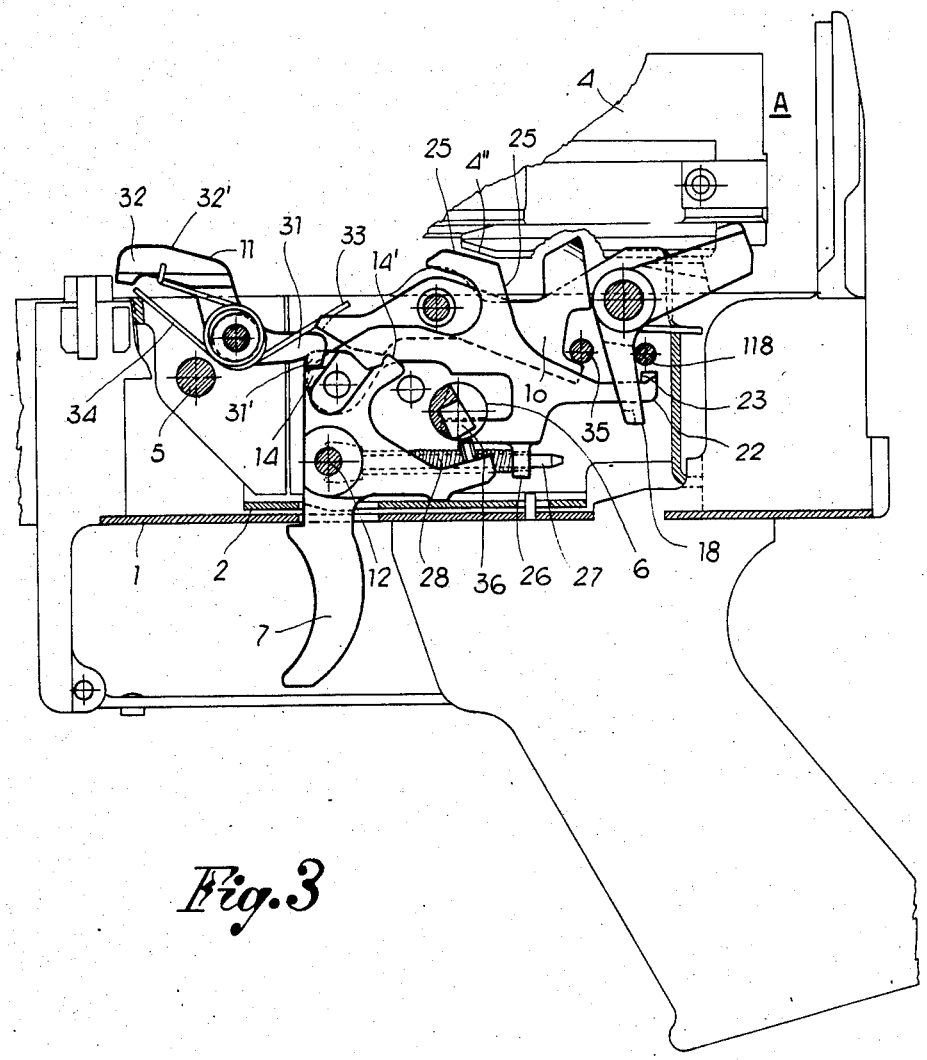
FIG. 3 is a view analogous to FIG. 2, but with the firing mode selector rotated, so as to use the rifle for single, individual firing of cartridges.
Figure 4:
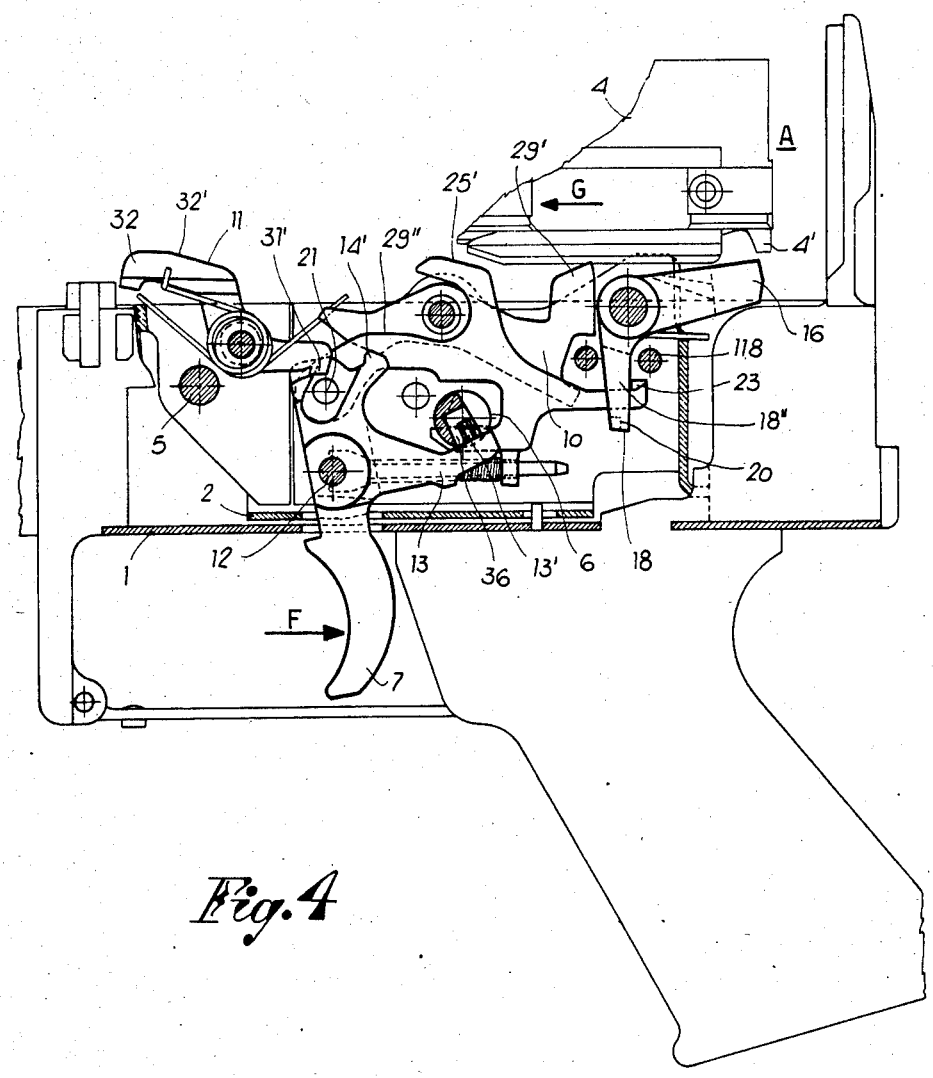
FIG. 4 is a view analogous to FIG. 3, but with the trigger in pulled position and the bolt carriage disengaged to allow its forward displacement.
Figure 5:
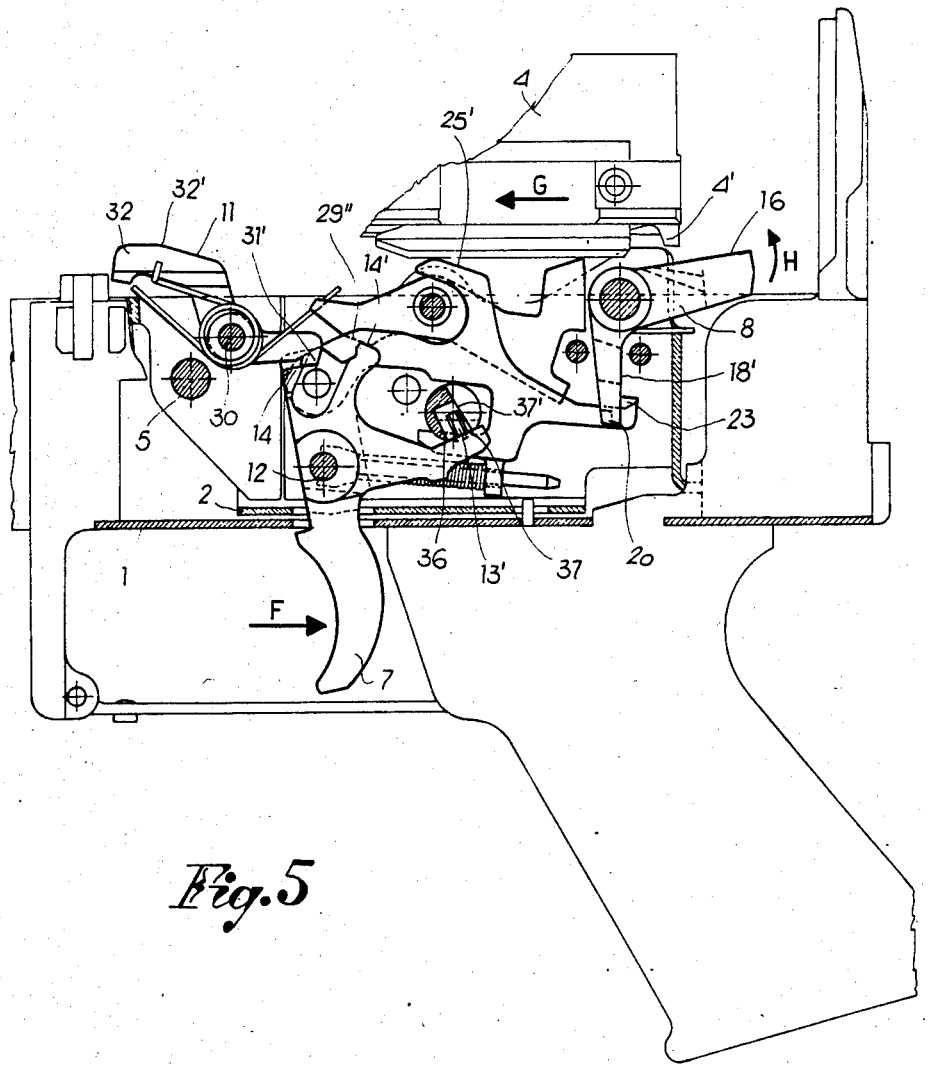
FIG. 5 shows the tripping mechanism in a position immediately following that illustrated in FIG. 4 and corresponding to the disconnection of the connectinq rod from the trip block.

For individual firing, it is sufficient to rotate the selector rod 6, in such a way that the cavity 26 be facing and be open toward the pin 13' on the tail 13 of the trigger, and the flat surface 39 be facing the horizontal surface 24' of the lower arm, C-shaped, 24 of the connecting rod 9, as shown in FIGS. 3-5 of the drawings. Consequently, the trigger 7 can be pulled and actuated; the connecting rod 9, urged by the spring 28, moves upwardly until its rear arm 22 rests against the ceiling of the notch 18' of the fork-1ike member 18 of the trip block 8. The stepwise shoulder 23 is, thus disposed in front of the full portion 18" of the fork-like member.

Concurrently, the top, inclined surface 25' of the C-shaped upper arm of the connecting rod 9 comes to rest on the trajectory of the bolt carriage, as shown in FIGS. 3 and 4.

Particularly, in FIG. 3, the trigger 7 is still in the rest position; the bolt carriage is blocked in the rear position by the trip block 8; the shoulder 23 of the rear arm 22 of the connecring rod is in position of interaction with the trip block 8; and the safety block 10 is in position of interception and arrest of the bolt carriage 4, in the eventuality that the letter become disengaged accidentally from the trip block 8. Thus, actuating the trigger in the direction of the arrow F in FIG. 4, a forwward movement is effected of the connecting rod 9 and, consequently, through the action of the shoulder 23 thereof, a rotation is effected for the trip block 8 in the sense for disengaging the bolt carriage 4, which then can advance in the direction of arrows G in FIG. 4 and FIG. 5 of the accompanying drawings. The actuation of the trigger, besides the disengagement of the bolt carriage 4, determines, concurrently, by means of the upper member portion 14' (which acts upon the cam-shaped appendix 29'' of the safety block 10), a rotation of the safety block 10, so as to displace the rear terminal 29' outside the trajectory of interception of the bolt carriage 4.

The bolt carriage can, thus, move freely from position A to the percussion or firing position B. However, during its forward movement, the bolt carriage engages the inclined surface 25' of the C-shaped upper arm 25 of the connecting rod 9, thus determining a downwardly displacement of the latter, as shown in FIG. 5. What results is a disconnection of the rear shoulder 23 of the connecting rod 9 from member 18'' of the trip block 8. The trip block 8, in turn, is disengaged and is urged by its spring 19, so as to rotate in the direction of the arrow H in FIG. 5, returning to its initial position of interception and arrest of the bolt carriage, when the latter is again displaced in the rear or backward position A. This occurs even if the trigger is still being pulled. Before firing the successive shot, it is necessary to relinquish the pressure upon the trigger. Then, the connecting rod 9, urged by the spring 28, returns also to the initial position—see FIG. 3—which establish the connection of the stepwise shoulder 23 with the member portion 18''; similarly, the safety block 10, no longer engaged by member 14' of the trigger and urged by its spring 33, returns to the operative position to, eventually intercept the bolt carriage 4 if the latter accidentally does not engage or escapes from the trip block. At this point, pulling again the trigger, another shot is fired with the same sequence described hereabove.

It is to be observed that, during individual firing, the excursion of the trigger is limited by the surface of lesser depth 37 of the first cam-like portion of the selector rod 6, while the engaging lever 11 remains idle, because the position of the trigger, once actuated, is such that the tooth 14 (the upper one) cannot engage the peg of this lever, as it can be seen in FIGS. 4 and 5 of the drawings.

Figure 6:
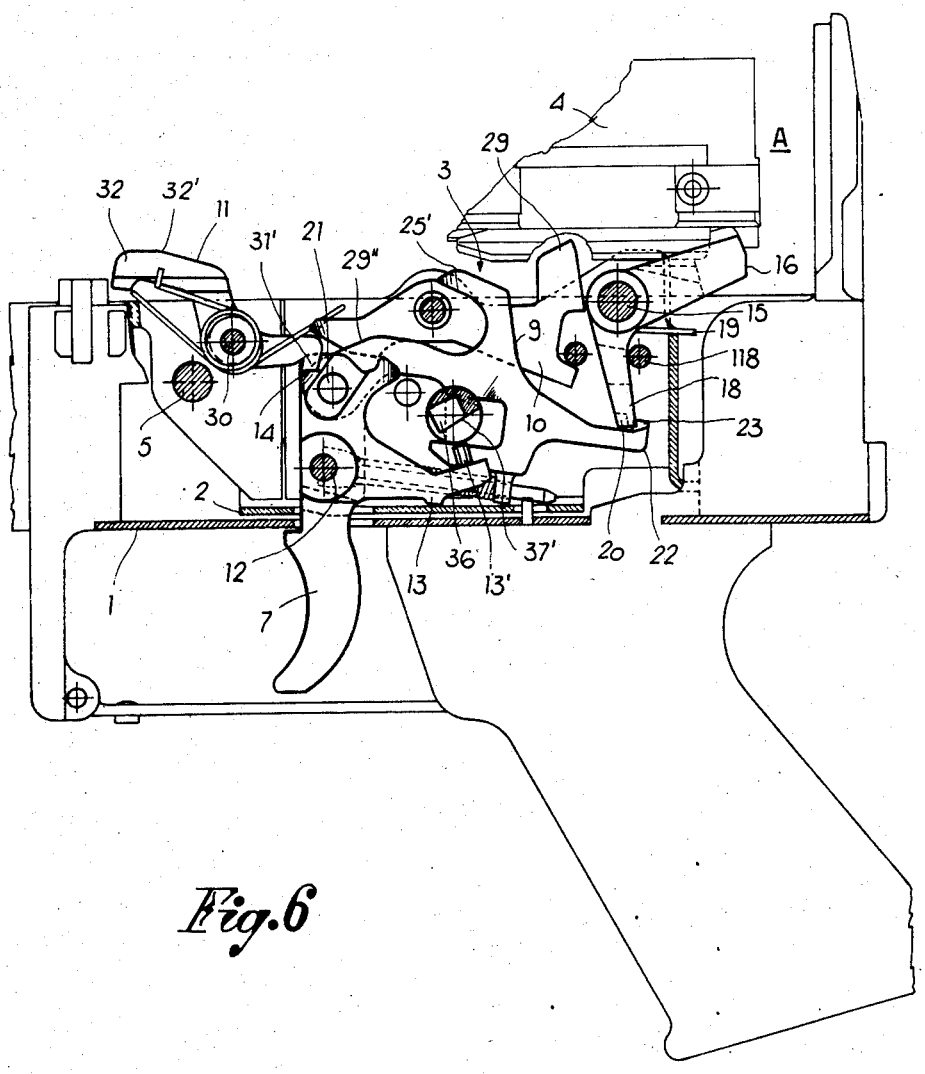
FIG. 6 shows the tripping mechanism assembled at the beginning of an automatic fire volley.

For automatic firing, it is necessary to rotate the selector rod 6, so as to position the cavity 36, still facing and open toward the pin 13' on the tail 13 of the trigger and the flat surface 37' (of greater depth) facing toward the tail of the trigger. Concurrently, the cylindrical surface 40, opposite to the other flat surfaces 39–39' of the selector rod 6, engages the portion 24' of the lower arm 24 of the connecting rod 9, thus displacing and keeping downwardly the latter in such a way that the stepwise shoulder 23 of the rear arm 22 is level with the pegs 20 of the fork-like member 18 of the trip block 8, as shown in FIG. 6 of the drawings. On the other hand, the upper arm 25 of the connecting rod 6 is displaced downwardly, outside of the trajectory of the bolt carriage 4.

Figure 7:
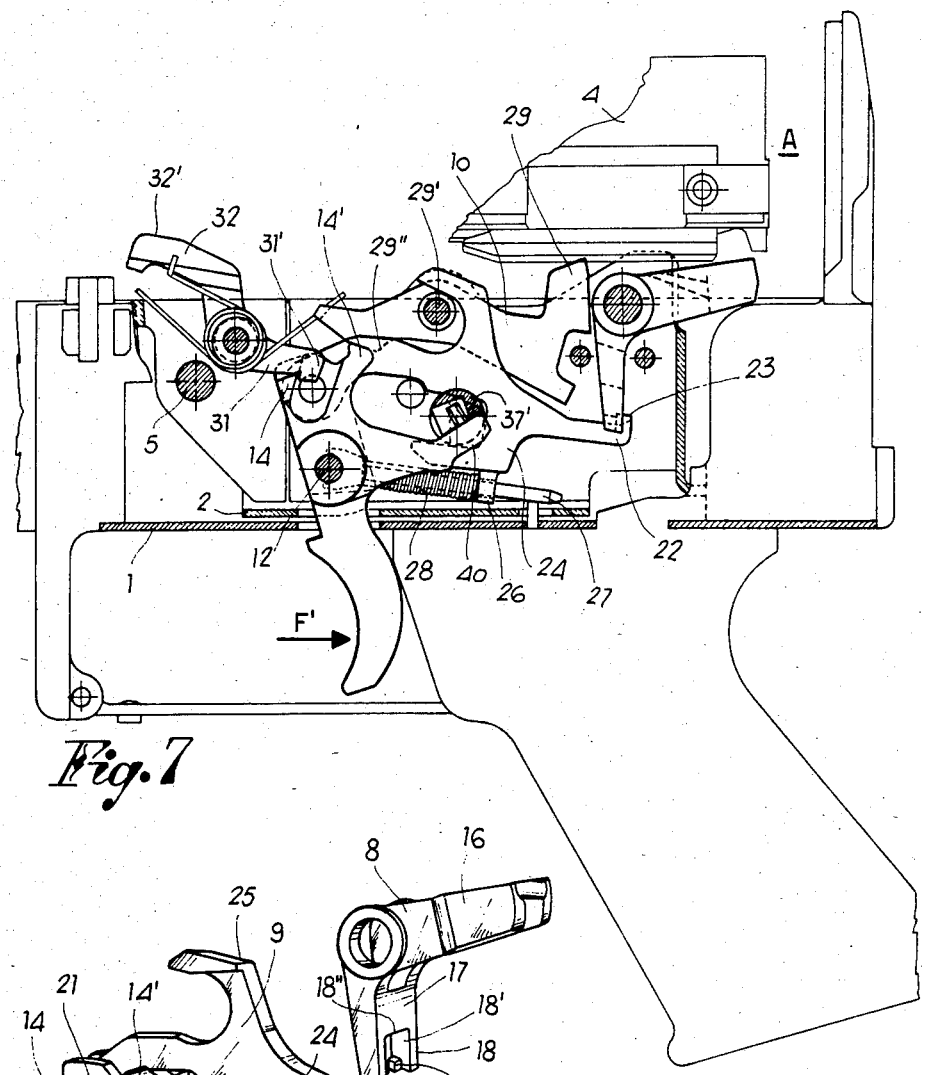
FIG. 7 shows the position of the mechanism with the trigger pulled during an automatic fire volley.
Figure 8:
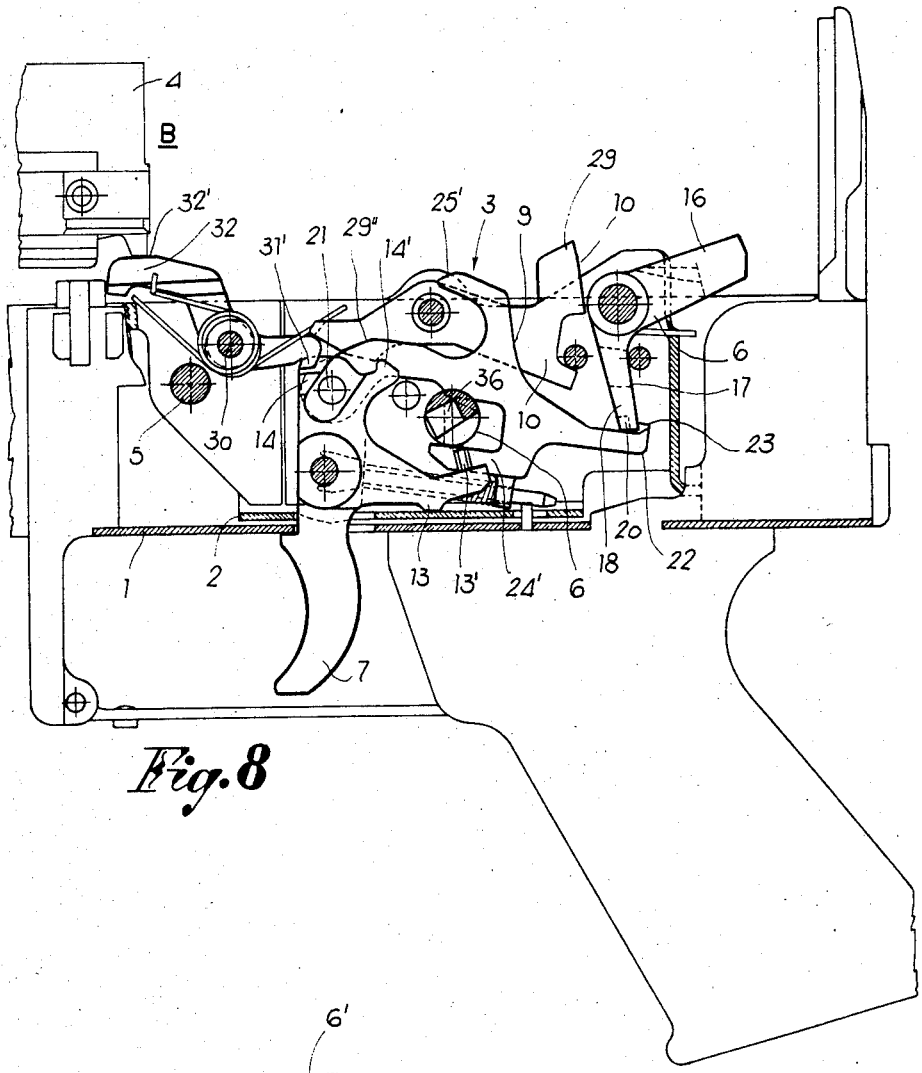
FIG. 8 shows the mechanism when the rapid automatic fire is interrupted.

Then, the action of the trigger in the direction of the arrow F'—FIG. 7—determines through the connecting rod 9 the rotation of the trip block 8 to disengage the bolt carriage 4 at the time of firing the first of the volley of shots. The action of the trigger, the excursion of which is this time determined by the deeper flat surface 37' of the selector rod 6, determines, besides the disengagement of the bolt carriage 4, the displacement of the safety block 10 in the idle position by means of member 14' of the trigger. At the same time, there occurs the coupling of the tooth 14 of the trigger with the peg 31' of the engaging lever 11, the second arm 32 of which, urged by the spring 34, moves upwardly in the trajectory of the bolt carriage. The engagement of the trigger by the lever 11, as shown in FIG. 7, is only temporary and merely to prevent the return of the trigger to the idle position, in the event that the trigger be relinquished in that fraction of time required for the bolt carriage to overshoot, during its forward excursion, the rear terminal 29' of the safety block 10. In this manner, the bolt carriage 4, once disengaged by means of the trigger, can no longer be intercepted and arrested by the safety block. At the end of its excursion in the forward direction at B, the bolt carriage acts upon the upper surface 32' of the second arm 32 of the engaging lever 11, rotating the latter in such a manner as to disengage the rear peg 31' from the tooth of the trigger 7, as shown in FIG. 8. If the trigger is being pulled still, as illustrated in FIG. 7, the trip block 8 and the safety block 10 are fixedly arrested in the idle position without the ability of intercepting the bolt carriage 4, which is thus able to advance and recoil for an automatic, continuous firing. On the other hand, when the trigger is freed and allowed to return to its idle position, the trip block 8, no longer held by the connecting rod 9, returns to the operative position of interception and arrest of the bolt carriage, thus interrupting the automatic mode of firing. Similarly, the safety block 10, urged by the spring 33, moves into the operative position, restoring the initial conditions —see FIGS. 6 and 8. From this moment it will be possible to start again, by pulling the trigger, the automatic mode of firing, or to rotate the selector rod 6 to move the rifle into safety position or into position for the individual mode of firing.

What is claimed is:

1. Tripping mechanism for the conversion of closed-bolt type automatic rifles having a trip box, to open bolt-type automatic rifles having a bolt carriage displaceable from a rearward, armed position to a forward, firing position, said bolt carriage being provided with a shoulder for the rearward arrest thereof, said mechanism comprising:

a box-like support removeably insertable, as a unit, in said trip box, said mechanism cooperating with said bolt carriage and with a safety rod which functions as a selector for the firing modes of the rifle, said modes being an individual shot firing mode and an automatic firing mode, said box-like support having mounted thereon (a) a trigger, rotating about a first pin and having a rear wall cooperating with said selector and further having an upwardly facing arm ending with a thrusting portion and a tooth; (b) a trip block pivoting on a second pin and having a first spring-urged arm for engagement with said shoulder of said bolt carriage and a second downwardly facing arm; (c) a connecting rod pivoting about said upwardly facing arm of said trigger, and having a rear arm with a rear shoulder at the extremity thereof for engagement with and disengagement from said second arm of said trip block, said connecting rod having a lower arm engageable by said selector, and an upper arm having a top inclined surface engageable by said bolt carriage; said selector extending transversely within said box-like support to be positioned between said tail of said trigger and said lower arm of said connecting rod.

2. Tripping mechanism according to claim 1, wherein said box-like support further contains mounted thereon a safety block, pivoting about a third pin and having a rear terminal for intercepting said shoulder of said bolt carriage and a frontal, cam-like appendix cooperating with said thrusting portion of said trigger for the determination of the displacement of said safety block in an idle position; said safety block being actuated by a spring.

3. Tripping mechanism according to claims 1 or 2, wherein said box-like support further contains mounted thereon a spring-actuated engaging lever, pivoting about a fourth pin and having a first arm with a peg facing toward and cooperating with said tooth of said trigger, and a second arm with an upper pin, positioned in the trajectory of said bolt carriage.

4. Tripping mechanism according to claim 1 wherein an extremity of said downwardly facing arm of said trip block is fork shaped, the two branches of said fork-shaped extremity defining a notch open downwardly and closed upwardly by a full portion; said two branches having two pegs facing inwardly toward each other.

5. Tripping mechanism according to claim 4, wherein the rear arm of connecting rod is inserted within said notch, so that the rear shoulder of said connecting rod cooperates selectively with one of said full portion and said pegs, the cooperation between said rear shoulder and said one of said full portion and said pegs being determined by said rear shoulder of said connecting rod; said selector having means for positioning said connecting rod in a neutral position, wherein said rear shoulder of said connecting rod is intermediate said full portion and said pegs.

* * * * *